US007377454B2

(12) United States Patent
Klopfenstein et al.

(10) Patent No.: US 7,377,454 B2
(45) Date of Patent: May 27, 2008

(54) DEVICE FOR PUMPING A LIQUID FROM A PACKAGING OR A CONTAINER

(75) Inventors: André Klopfenstein, La Neuveville (CH); Elmar Mock, Colobier (CH); Naomi Bitmead, Niederwangen (CH); Emmanuel Simont-Vermot, Neuchâtel (CH)

(73) Assignee: Nestec S.A., Vevey (CH)

( * ) Notice: Subject to any disclaimer, the term of this patent is extended or adjusted under 35 U.S.C. 154(b) by 195 days.

(21) Appl. No.: 10/550,522

(22) PCT Filed: Mar. 17, 2004

(86) PCT No.: PCT/EP2004/002750

§ 371 (c)(1),
(2), (4) Date: Sep. 22, 2005

(87) PCT Pub. No.: WO2004/084688
PCT Pub. Date: Oct. 7, 2004

(65) Prior Publication Data

US 2006/0201332 A1 Sep. 14, 2006

(30) Foreign Application Priority Data

Mar. 24, 2003 (EP) ..... 03006556

(51) Int. Cl.
*A62C 11/00* (2006.01)

(52) U.S. Cl. ..... 239/335; 239/135; 239/309; 239/328; 239/346; 239/373; 239/419.5; 239/428.5; 236/346; 99/293; 261/78.2; 222/95; 222/146.1

(58) Field of Classification Search ..... 239/128, 239/135, 302, 309, 328, 335, 373, 419.5, 239/600, 428.5, 346, 369; 261/78.1, 78.2; 222/92, 95, 146.1, 566, 146.4, 572; 99/293, 99/295

See application file for complete search history.

(56) References Cited

U.S. PATENT DOCUMENTS

| | | | | |
|---|---|---|---|---|
| 2,310,633 | A | 2/1943 | Heimburger | |
| 3,490,356 | A * | 1/1970 | Peterson et al. | 99/295 |
| 3,652,015 | A | 3/1972 | Beall | |
| 4,603,621 | A * | 8/1986 | Roberts | 239/600 |

(Continued)

FOREIGN PATENT DOCUMENTS

| | | |
|---|---|---|
| DE | 10033033 | 6/2002 |

(Continued)

*Primary Examiner*—Steven J. Ganey
(74) *Attorney, Agent, or Firm*—Bell, Boyd & Lloyd LLP

(57) ABSTRACT

The invention relates to a device for pumping a liquid from a packaging, for the distribution thereof in a heated, foamed or emulsified form, comprising a sub-assembly for aspiration by venturi effect which can be connected to the tubing of a pressurized liquid flow generator. Said sub-assembly comprises a body with a liquid flow inlet duct, opening out in an aspiration chamber and at least one aspiration duct for the liquid contained in the packaging. The invention is characterized in that the aspiration sub-assembly comprises a nozzle and fixing and opening means, connecting the nozzle to the packaging and connecting the aspiration duct with the liquid inside the packaging. The invention is of application to the production of cappuccinos or other foamed drinks.

21 Claims, 8 Drawing Sheets

U.S. PATENT DOCUMENTS

| | | | | |
|---|---|---|---|---|
| 4,800,805 | A | | 1/1989 | Mahlich et al. |
| 4,808,346 | A | * | 2/1989 | Strenger ..... 222/95 |
| 4,852,473 | A | * | 8/1989 | Azpitarte Bolivar ..... 239/428.5 |
| 5,265,519 | A | | 11/1993 | Schieltecatte et al. |
| 5,335,588 | A | | 8/1994 | Mahlich |

FOREIGN PATENT DOCUMENTS

| | | |
|---|---|---|
| EP | 0243326 | 10/1987 |
| EP | 0803219 | 10/1997 |
| EP | 0803220 | 10/1997 |
| WO | 8909094 | 10/1989 |

* cited by examiner

DEVICE FOR PUMPING A LIQUID FROM A PACKAGING OR A CONTAINER

BACKGROUND

The most customary way of obtaining such a frothy emulsion is to pour the desired amount of milk into a container, to immerse the steam outlet pipe in said container, shaking it up and down to get in the air necessary to form the froth. The quality of the froth obtained depends on the skill of the user who, when not a professional, may also be subject to splashing. For hygiene reasons, it will be appreciated that the pipe and the container containing the milk need to be cleaned after each use.

In order to try to obtain a more uniform quality of froth, various types of venturi-effect devices have been proposed in order to act somewhat as an interface between the steam outlet of an expresso coffee machine and a container containing milk.

The simplest type of venturi-effect device, described for example in patent U.S. Pat. No. 4,800,805, consists in an air carrying tube secured to the steam outlet pipe and having its opening positioned below said outlet, the entity having to be immersed in a container containing the desired amount of milk. The improvement described in patent U.S. Pat. No. 5,335,588 consists in securing the air line to a sleeve which can itself be fitted to the steam outlet pipe, the entity still having to be immersed in a container containing the milk.

Patent EP 0 243 326 describes a venturi-effect accessory that can be fitted to an expresso coffee machine, comprising a great many parts making it possible, in an aspiration chamber, to have an arrival of pressurized steam which, through a venturi effect, entrains air along a first duct and entrains along a second duct milk arriving from a reservoir incorporated into the machine or aspirated from a standard packaging by means of an immersed connecting dip tube. This mixture is then injected into a mixing chamber before leaving in the form of a froth.

An improvement proposed in patent U.S. Pat. No. 5,265,519 corresponds to an accessory of simpler design, with fewer parts to be assembled to form the venturi-effect nozzle, but still comprises an immersed connecting dip tube for carrying the milk. The device further comprises an anti-splash cap at the frothy preparation ejection orifice.

Patents EP 0 803 219 and EP 0 803 220 B1 also describe a device for preparing a frothy milk or cappuccino by pumping by means of two tubes immersed in a container of the cardboard carton type and connected to a venturi-effect device. Such a device is designed to accept a large-capacity container and therefore needs a refrigeration system in order to preserve the milk.

In all the cases, the immersed connecting dip tubes need to be cleaned after each "cappuccino". It will also be seen that the accessory, which is not designed to be disposable, requires periodic upkeep if the production of cappuccinos are spaced-out, and that the amount of cappuccino produced from one occasion to the next is also dependent on the care taken by the operator.

SUMMARY

The subject of the present invention is a device for pumping a liquid from a packaging using a venturi effect so as to dispense it in frothed or emulsified and possibly heated form. Although the invention preferably relates to the field of food for producing emulsified milk-based drinks, it is not in any way limited to this field and may be applied to any product that can be pumped from a packaging, such as cosmetic products in the form of pumpable creams or the like.

The expression "venturi-effect device" is intended to mean an aspiration subassembly for aspirating at least one pumpable phase, typically a liquid, comprising a chamber in which there opens a canal for carrying a fluid pressurized by a constriction so as to create an aspiration effect as a result of the depression at the outlet from the constriction in at least one canal connecting said chamber and the packaging connecting the pumpable liquid, it being possible for the carrier fluid to be a gas or a liquid, for example steam, hot or cold water, air, or a mixture thereof. This aspiration subassembly makes it possible to modify the pumpable liquid and distribute it in the form of a frothed preparation, that is to say in a liquid-gas mixture, or in emulsified form, that is to say in a mixture of two non-miscible liquids and/or possibly heated by applying the heat of the carrier fluid to the pumpable liquid. The preparation thus obtained may, for example, be chilled milk, milk-based drinks, for example flavored, coffee, tea, chocolate, soup or preparations for cappuccinos or moccaccinos.

The invention will, however, be illustrated in the context of the production of "cappuccinos", that is to say when the device is associated with a pressurized steam generator, usually the pipe of an expresso coffee machine and when the pumpable liquid is milk allowing a frothy air/milk/steam emulsion to be obtained.

The invention is therefore aimed at palliating the disadvantages of the aforementioned prior art by virtue of a novel type of device that can be manufactured economically and makes it possible to obtain a frothy, emulsified and/or heated preparation of the cappuccino type, or another frothed milk-based or other drink, exhibiting froth that is uniform in terms of quality and in terms of quantity, under improved hygiene conditions.

To this end, the subject of the invention is a device for pumping a liquid from a packaging so as to dispense it in frothed or emulsified, and as appropriate, heated, form, comprising an aspiration subassembly of the venturi type, able to be connected to the pipe of a pressurized-carrier fluid, such as steam or hot water, generator, the subassembly comprising a body having a carrier fluid carrying duct opening into an aspiration chamber, and at least one aspiration canal for aspirating the liquid contained in the packaging, characterized in that the aspiration subassembly comprises a nozzle and fixing and opening means designed to connect the nozzle with the packaging and place the aspiration canal in contact with the liquid inside the packaging.

The advantage is thus that of being able quickly and easily to combine the aspiration and mixing means so as to form a froth, or possibly an emulsion, with the packaging itself. Preparation is thus made more convenient and more hygienic.

As a preference, the packaging is closed by a seal and the fixing and opening means are designed to be secured to the seal, the nozzle can move relative to the packaging between a position in which the packaging is closed and a position in which the packaging is opened by the fixing and opening means, the aspiration canal thus being placed in communication with the liquid contained in the packaging. Opening is thus easy and renders the device operational, without further handling operations being needed.

The fixing and opening means are also preferably arranged in such a way as to place the aspiration canal in communication with the liquid contained in the packaging without the possibility of flow to the outside. The expression "without the possibility of flow to the outside" is to be understood as meaning that the liquid contained in the packaging is not likely to flow or spill out of the packaging without a forced aspiration effect of the by the venturi-effect aspiration subassembly. For example, the fixing and opening means collaborate with the packaging to place the canal in communication near to the bottom of the liquid. A differential hydrostatic pressure is thus created which keeps the liquid in the packaging without the risk of possible flow.

In one embodiment of the invention, the fixing and opening means are means capable of undoing a portion of the weld between the seal and the packaging. The fixing and opening means may be means for trapping a portion of the seal which, when the nozzle is displaced by a relative movement with respect to the packaging, causes a portion of the weld between the seal and the packaging to rupture. Such a solution has the advantage of ensuring ease of opening, that is reliable without the risk of the liquid flowing or leaking out of the device. For example, a joining element is provided able to connect the nozzle to the seal by trapping and/or welding with a portion of the seal. The advantage of a joining element is that it allows the packaging and the nozzle to be separate, it being possible for the two elements to be assembled at the time of preparation or, by contrast, in advance, for example at the time of manufacture.

A packaging of the aforementioned type is the subject of a more detailed description in an application filed this very day by the Applicant Company, entitled "Disposable packaging for the distribution of a liquid preparation pumped by a venturi-effect device", incorporated hereinto by reference.

In the aforementioned embodiment, the joining element partially forms the ejection duct, and is provided with a through-passage and with a flange making it possible by screwing or clipping onto the end of the body of the nozzle, to trap a ring of the seal in a sealed manner between the base of the nozzle and said flange.

In a possible alternative, the nozzle is welded directly to a portion of the seal by a weld which is more resistant to rupture than the means of welding between the seal and the packaging. In this case, the nozzle is assembled at the time of manufacture. The advantages are also ease of production, simplicity and lower cost.

The device of the invention may constitute an assembly comprising the aspiration subassembly and the associated packaging, it being possible for the entire entity to be disposable and therefore to require no cleaning.

As will be seen in the detailed description which follows, the nozzle may be produced economically in a single piece by injection molding and be associated either with a packaging in the form of a capsule, manufactured by thermoforming or injection molding, hermetically sealed before use, and containing one or more helpings of pumpable liquid, or with a container or a bowl of larger capacity. The nozzle may also be formed of several elements fitted together and/or assembled with one another.

According to one feature of the aspiration subassembly, the aspiration chamber is situated downstream of a restriction and is connected upstream of a constriction to a mixing well itself in communication with the outside via an ejection duct. The restriction is typically configured to ensure a passage at high speed, generally at sonic speed, of the carrier fluid so as to create within the aspiration chamber the depression needed for aspirating the liquid.

Homogenizing means are advantageously provided, either forming part of the aspiration subassembly or of the means of closing the packaging itself.

Thus, in order to form the means of homogenizing the ejected product, the assembly element may be extended, in the mixing well, by a dome having a diameter slightly smaller than that of the mixing chamber.

When the nozzle is welded directly onto a portion of the seal, the welded portion delimits an opening in the seal and the ejection duct is designed to communicate with this opening. A grating may be positioned across this opening to form means of homogenizing the ejected product.

According to another aspect of the invention, the liquid aspiration canal preferably runs between the base of the nozzle and the aspiration chamber.

According to yet another aspect of the invention, the nozzle is housed in a hollow shaft formed at right angles to the plane of the seal of packaging, one end of the hollow shaft being connected to the seal by a second welded portion. This hollow shaft may occupy any position, for example may be formed as an integral part of an edge of the container. However, according to a preferred embodiment, the hollow shaft occupies a central position.

According to another aspect, another subject of the invention is a device for pumping a liquid from a container so as to dispense it in frothed or emulsified and, as appropriate, heated, form, comprising an aspiration subassembly formed by a nozzle of the venturi type able to be connected to the pipe of a pressurized-carrier fluid generator, said subassembly consisting of a body comprising a carrier fluid carrying duct opening into an aspiration chamber, and at least one aspiration canal for aspirating the liquid contained in the container and opening into said container, characterized in that the liquid supply canal is formed in the actual body of the nozzle between its base and the aspiration chamber, and in that the ejection duct passes through the end wall of the container, forming a seal against the liquid contained in said container.

In another possible alternative, the fixing and opening means are means of perforating a portion of the seal. These may, for example, be at least a rigid puncturing portion comprising a liquid aspiration canal. Such an alternative is described in detail in the co-pending patent application entitled "Disposable packaging for the distribution of a liquid preparation pumped by a venturi-effect device" filed this very day in the name of the Applicant Company and incorporated hereinto by reference.

Additional features and advantages are described herein, and will be apparent from, the following Detailed Description and the figures.

DETAILED DESCRIPTION

Figure 1:
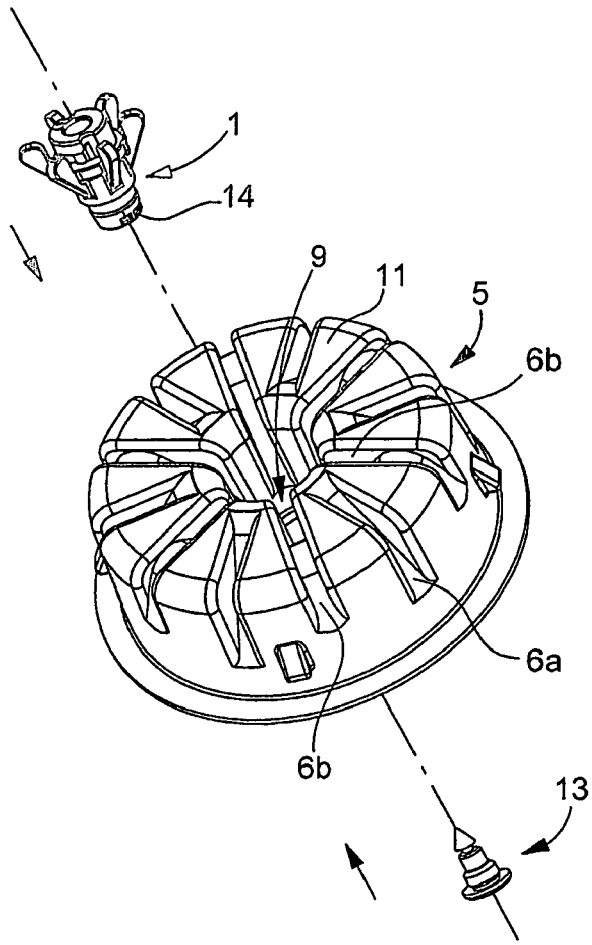
FIG. 1 is an exploded perspective view of a first embodiment of a pumping device according to the invention illustrating the two components that form a venturi-effect device, prior to assembly on a packaging having the form of a disposable capsule.

FIG. 1 depicts, in exploded perspective, a first embodiment of a pumping device according to the invention comprising an aspiration subassembly comprising a venturi-effect nozzle denoted by the general reference 1. The nozzle 1 is associated with a packaging 5 having the form of a capsule closed by a deformable seal 7 visible in FIG. 2. The packaging 5 comprises a hollow shaft 9 running from the end wall 11 as far as the seal 7 which is provided with an opening 8 concentric with the opening of the hollow shaft 9 and the dimensions of which are more or less equal to or smaller than the opening of the hollow shaft 9. Typically, the capsule may be obtained in a single piece by thermoforming or molding a plastic. In the example illustrated, the packaging has a toric overall shape.

Figure 2:
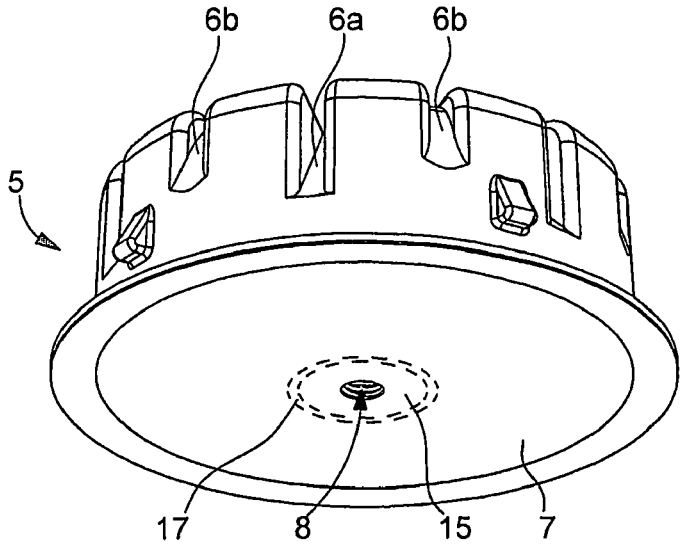
FIG. 2 is a perspective of the capsule alone viewed from underneath.

The hollow shaft 9 is designed to accommodate, at the end wall 11 end, the nozzle 1 and, at the seal 7 end, a joining element 13 assembled with the base 14 of the nozzle 1 to form fixing and opening means. In this first embodiment, the joining element 13 is fixed by screwing to the nozzle 1, but could be fixed to the latter in any other way, such as by clipping. FIG. 2 also depicts, in dotted line, a ring 15 for trapping the seal 7 between the nozzle 1 and the joining element 13, and a welding ring 17 at the base of the hollow shaft 9 which rings will be described in greater detail hereinafter in conjunction with FIGS. 10 to 13.

Figure 3:
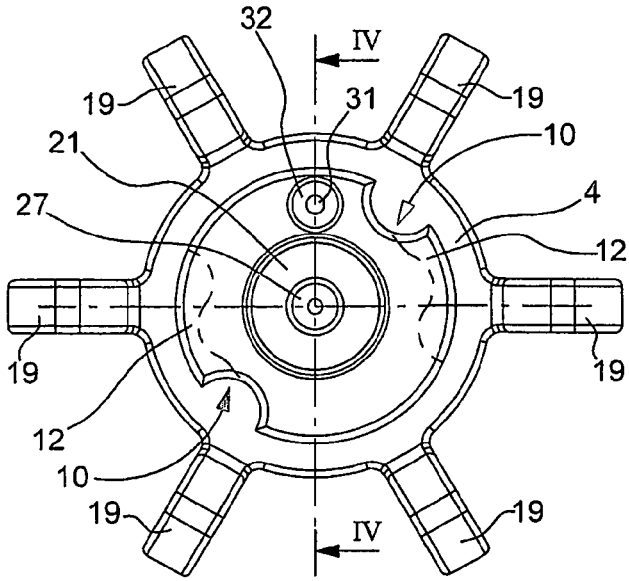
FIG. 3 is a view from above of a venturi-effect device according to a first variant of the invention able to be used with the first embodiment of the pumping device.
Figure 4:
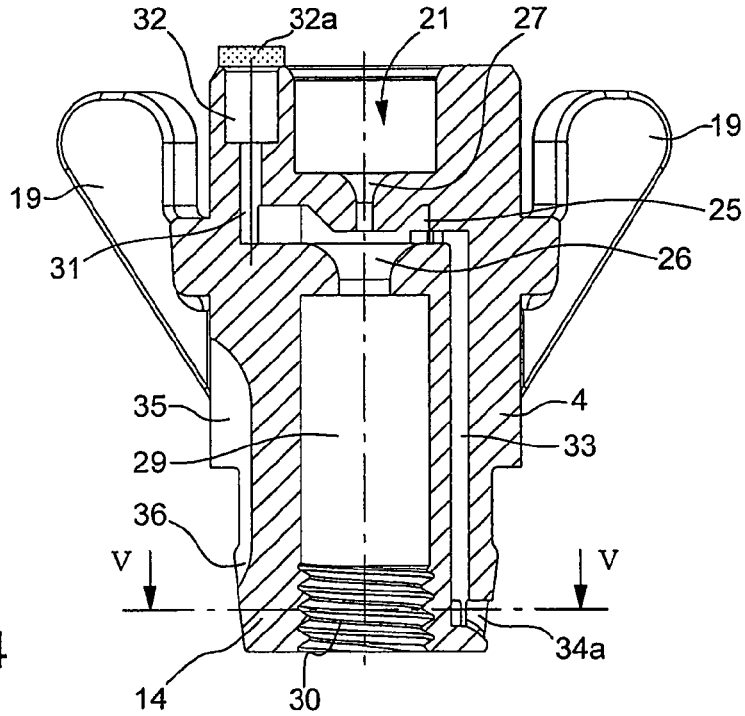
FIG. 4 is a section on IV-IV of FIG. 3.

Referring also to FIGS. 3 and 4, it can be seen that the nozzle 1 has a body 4 which is cylindrical overall except for fins 19 the role of which will be explained later. At its upper part, the nozzle 1 comprises a steam inlet well 21 in which a sleeve 22 of an adapter 23 (visible in FIGS. 9, 10 and 11) for attaching to the pipe of a steam generator, for example that of an expresso coffee machine, will be housed. In the example depicted, the adapter 23 is of the "bayonet" type and collaborates with two cutouts 10 and two grooves 12 which are diametrically opposed and formed in the upper part of the nozzle 1. The fins therefore allow the nozzle to be prevented from rotating relative to the capsule.

Incorporating the steam inlet well 21 into the body of the nozzle makes it possible to avoid any suck back of the pumped liquid, which could occur because of turbulence in the aspiration chamber 25 and therefore keeps the steam inlet pipe out of contact with the liquid and therefore always perfectly clean.

Referring more specifically to FIG. 4, it can be seen that the steam inlet well 21 communicates with an aspiration chamber 25 via a very small diameter restriction 27 allowing the carrier fluid to be made to pass at a sonic speed or at least at a speed close to the speed of sound. This restriction 27 is a reduction in cross section which thus generates a depression in the aspiration chamber 25 required for the desired venturi effect. In an equivalent manner, the steam carrying well 21 and the restriction 27 could be formed in a component independent of the rest of the nozzle, or be formed with the steam carrying pipe when the latter is pushed into the nozzle.

Downstream of the aspiration chamber 25 there is a constriction 26 of a larger diameter than restriction 27 and which allows the passage flow rate of the aspirated liquid to be regulated according to the speed. The aspiration chamber 25 is itself in communication with a mixing well 29 via the constriction 26. Also opening into the aspiration chamber 25 are an air carrying canal 31 and a canal 33 carrying or pumping the liquid contained in the packaging.

As is known, the final quality of the froth depends on numerous factors, particularly on the air flow rate that can be controlled with very precise calibration of the air carrying canal 31. Knowing that the diameter of this canal is of the order of a few tenths of a millimeter, it will be understood that such calibration is a relatively tricky matter, especially since this nozzle is designed for mass production, for example by injection-molding a plastic such as polypropylene (PP), polystyrene or any other appropriate plastic materials. This is why it is preferable to provide, at the air intake, a larger-diameter orifice 32 allowing the fitting of means allowing better control over the air flow rate. These are, for example, a permeable membrane, for example a controlled-porosity membrane 32*a* which is fixed over the orifice 32. A membrane of this type is available for example in the range of products offered by Atofina (Paris) under the trade name Pebax® or the company Gore (USA) under the trade name Goretex®. This membrane 27*a* may also, without modifying the body of the nozzle, make it possible to choose the porosity best suited to the pressure of a given steam generator. It will also be noted that the larger diameter of the orifice 32 allows it to be blocked off very easily if the nozzle is to be used, not for producing an emulsion, but simply for heating a liquid.

Figure 5:
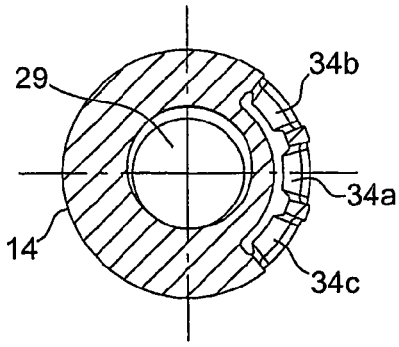
FIG. 5 is a section on V-V of FIG. 4.

FIG. 5 also shows that the liquid carrying canal 33 is formed inside the body 4 of the nozzle 1, the feed orifices 34*a*, 34*b*, 34*c* being situated in the example illustrated at the base 14 of the nozzle 1 and intended to be placed in communication with the inside of the packaging containing the liquid when the device is in the pumping configuration.

In the case of a nozzle designed to be fitted to a closed packaging (see FIGS. 1 and 2), the vertical exterior part of the nozzle 1 further comprises a groove 35 allowing the pressure inside the capsule to be equalized when the liquid contained in the packaging is pumped. The lower part 36 of this groove 35 is therefore designed to be in communication with the inside of the packaging containing the liquid when the device is in the pumping configuration.

Figure 6:
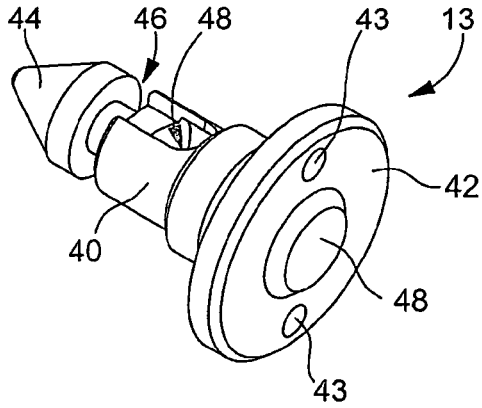
FIG. 6 is a perspective view of the joining element used in the variant of the venturi-effect device illustrated in FIGS. 3 and 4.
Figure 7:
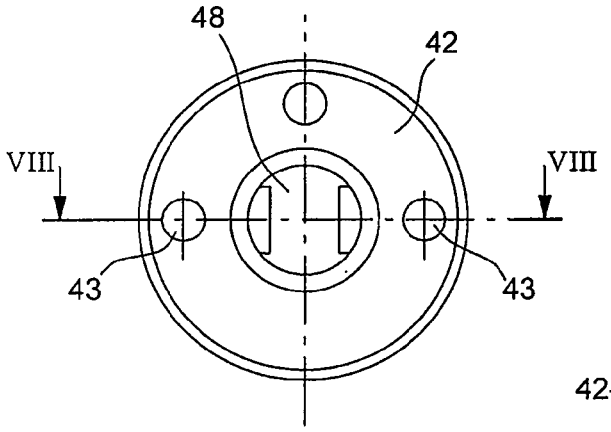
FIG. 7 is a view from underneath of the joining element depicted in FIG. 6.
Figure 8:
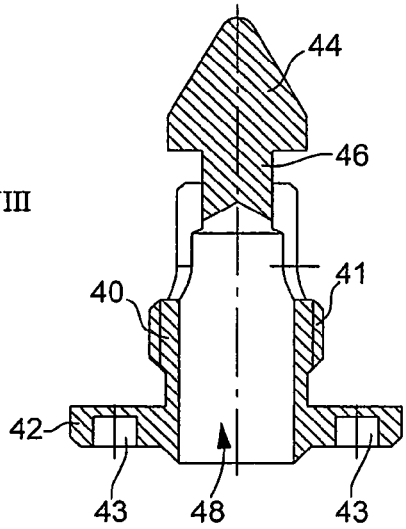
FIG. 8 is a cross-sectional depiction of the joining element on VIII-VIII of FIG. 7.

It can also be seen that the end of the mixing well 29 comprises an internal screw thread 30 allowing the joining element 13 to be fitted, an example of which joining element is described hereinafter with reference to FIGS. 6 to 8.

The joining element 13 comprises a body 40 having, at its base, a flange 42 and, at its other end, a dome 44. The dome 44 is connected to the body 40 by a constriction 46. A duct 48 for ejecting the heated and/or emulsified liquid is formed through the body 40 under the constriction 46 (FIG. 8). The body 40 comprises, near its base, an external screw thread 41 allowing the joining element 13 to be screwed onto the corresponding screw thread 30 of the nozzle 1. To make this screwing easier, the flange 42 comprises two operating holes 43, but it is obviously possible to conceive of other screwing means, including means of a tamperproof type. It may indeed be desirable, for hygiene reasons, for it not to be possible for the nozzle 1 to be removed and re-used after first use. The tamperproof nature may incidentally be obtained by providing other means allowing the assembly of the nozzle 1 and the joining element 13, for example by clipping. Finally, it will be seen that the diameter of the base of the dome 44 is very slightly smaller than the inside diameter of the mixing well 29 so that the emulsion has a forced passage between the wall of the mixing well 29 and the base of the dome 44 to improve the frothy nature and in particular to homogenize the preparation, and to limit the risk of splashes.

Figure 9:
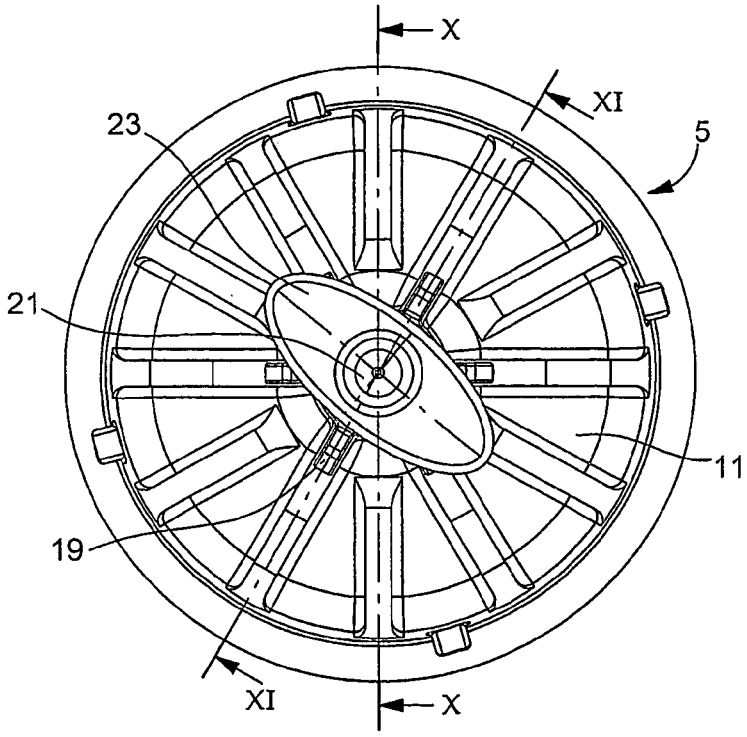
FIG. 9 is a view from above of the first embodiment of the pumping device depicted in FIG. 1 after assembly of the venturi-effect device illustrated in FIGS. 3 to 5 with the packaging.

With reference now to FIGS. 10 to 13, which are part sections on X-X and XI-XI of FIG. 9, the working of the nozzle 1 according to the first embodiment which has just been described, when fitted to the capsule 5, closed by the seal 7, as depicted in FIGS. 1 and 2 will be described hereinafter. These figures show that that the capsule 5 comprises a certain number of ribs, some ribs 6*a* essentially serving to reinforce the capsule 5, and other ribs 6*b* being designed to guide the fins 19 of the nozzle 1.

Figure 10:
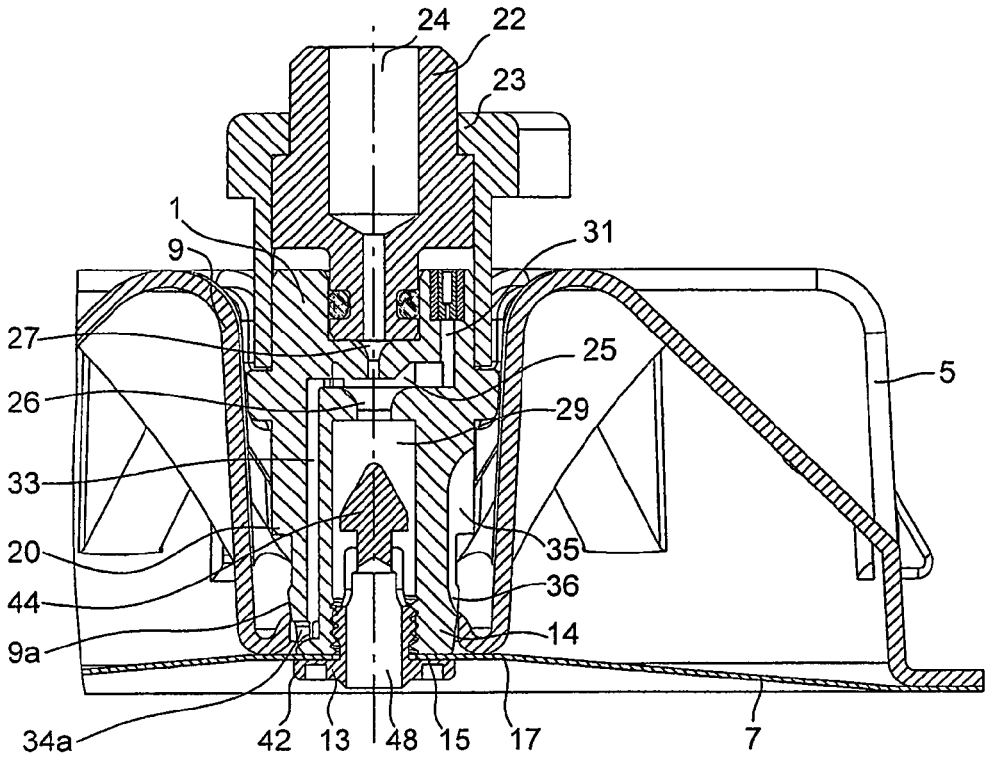
FIG. 10 is a depiction in section on X-X of FIG. 9, prior to the opening of the capsule.
Figure 11:
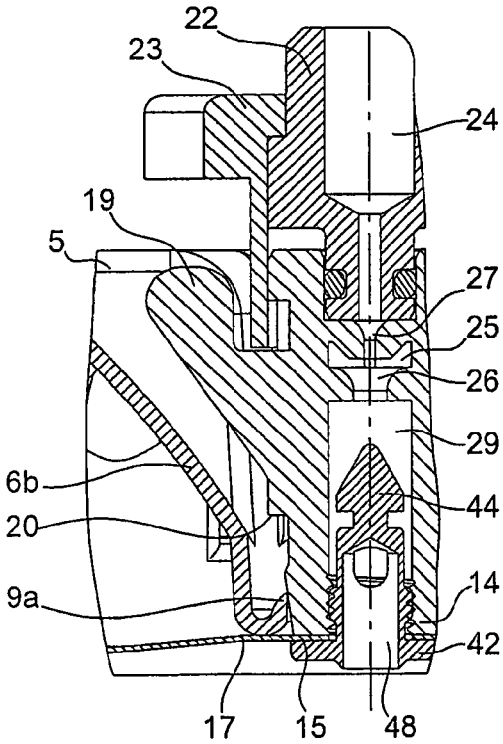
FIG. 11 is a depiction in section on XI-XI of FIG. 9, prior to the opening of the capsule.

FIG. 10 shows the nozzle-capsule assembly prior to opening, that is to say when the contents of the capsule 5 are not in communication with the liquid carrying canal 39. In this figure, the nozzle-capsule assembly is provided with the adapter 23 comprising a bayonet device allowing the attachment via the opening 24 of the connecting sleeve 22 to the well 21 via which the steam arrives in the nozzle 1.

The ring 15 of the seal 7 is trapped hermetically between the nozzle 1 and the joining element 13, and the end wall of the hollow shaft 9 is bonded or welded hermetically by the sealing ring 17 of the seal 7 surrounding the ring 15.

It is also possible to anticipate for the ring 15 to be welded to the base 14 of the nozzle 1 or alternatively to the flange 42 of the joining element 13. In this position, the liquid is completely isolated from the external surroundings, the liquid supply orifices 34*a, b, c* (FIG. 5) and air supply orifice 36 for equalizing the pressure all lying above the ring 17 hermetically welded to the seal 7. In the preferred embodiment depicted in FIG. 10, it can be seen that the length of the hollow shaft 9 is such that the seal 7 has a convex shape prior to opening.

Figure 12:
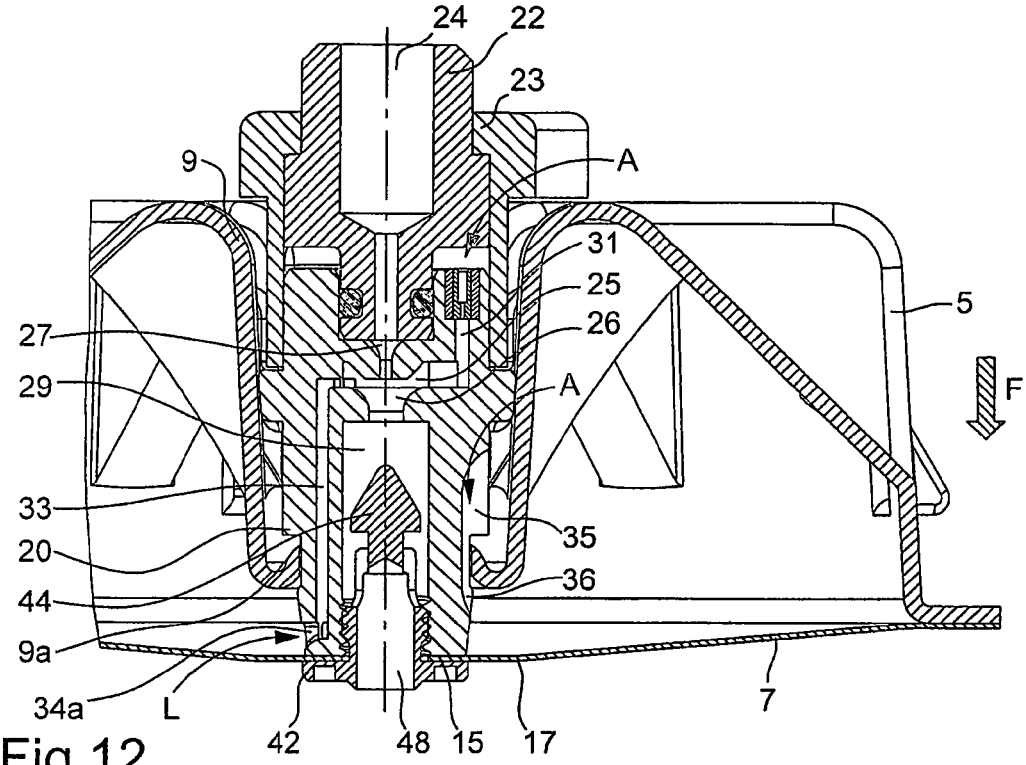
FIG. 12 corresponds to FIG. 10, after the capsule has been opened.
Figure 13:
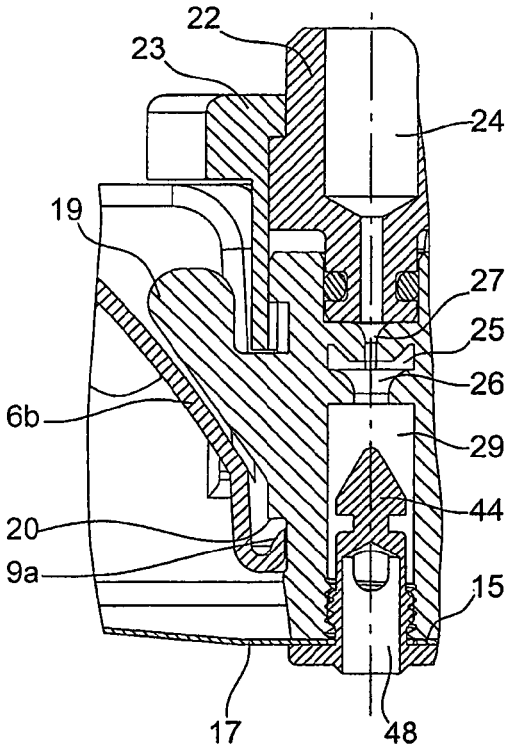
FIG. 13 corresponds to FIG. 11, after the capsule has been opened.

By displacing the capsule 5 axially relative to the nozzle 1 as indicated by the arrow F in FIG. 12, the ring 17 is made to come undone. The seal 7 then adopts a concave shape. This then on the one hand places the feed orifices 34*a* (34*b* and 34*c* not visible in the section) in communication with the liquid contained in the capsule and on the other hand places the bottom part 36 of the groove 35 in communication with the external air A to equalize the pressure inside the capsule 5. As can be seen in FIG. 13, in the open position, the travel of the nozzle 1 is limited by a shoulder 20 situated at the base of the nozzle coming into contact with a lower edge 9*a* of the hollow shaft 9, thus preventing the seal 7 from being torn by an excessively sharp movement. In this configuration, the liquid contained in the packaging 5 is not liable to flow freely in the liquid carrying canal 33 because of the pressure differential there is between the aspiration chamber 25 and the surface of the liquid in the packaging 5, the pressure in the packaging 5 naturally being lower than the pressure in the packaging 5 at the time of opening. The liquid cannot therefore flow freely out of the packaging 5 through the canal 33. The system is therefore clean.

In this open position, the arrival of a pressurized carrier fluid, for example steam, in the aspiration chamber 25 creates a depression in the carrying canal 33, which is in communication with the inside of the packaging 5, and in the air carrying canal 31, so that the liquid contained in the packaging 5 is pumped by a venturi effect, the pressure in the aspiration chamber thus dropping below the pressure above the liquid in the packaging 5. The liquid is therefore ejected into the mixing well 29 via the constriction 26 and is distributed after homogenization through the ejection duct 48 in the form of a hot emulsion in the present example. The groove 35 and the orifice 36 allow the packaging 5 to fill with air as it empties of the liquid thus pumped and ensure that the pressure within the packaging remains at a pressure higher than the depression created in order to ensure the continuity of the pumping and prevent the packaging 5 from collapsing inward. When the carrier fluid ceases to arrive, the aspiration chamber 25 then returns to a pressure slightly higher than the pressure of the liquid in the packaging 5, which ensures that the liquid in the canal 33 is retained without the possibility of it flowing to the outside. The small amount of vacuum produced in the head space of the packaging 5 is enough to retain the liquid at a controlled level in the canal 33.

Figure 14:
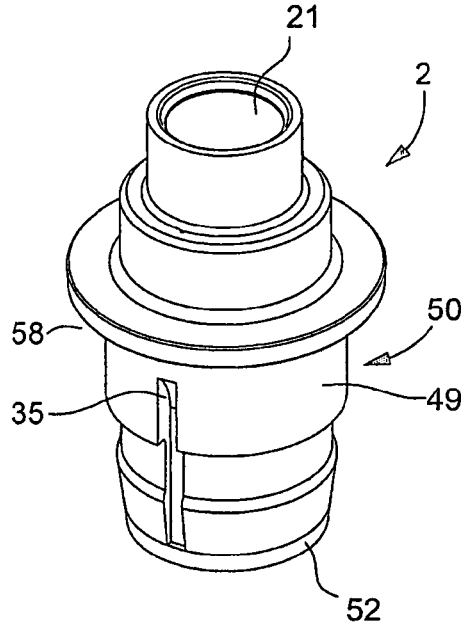
FIG. 14 is a perspective depiction of a second embodiment of a pumping device according to the invention.
Figure 15:
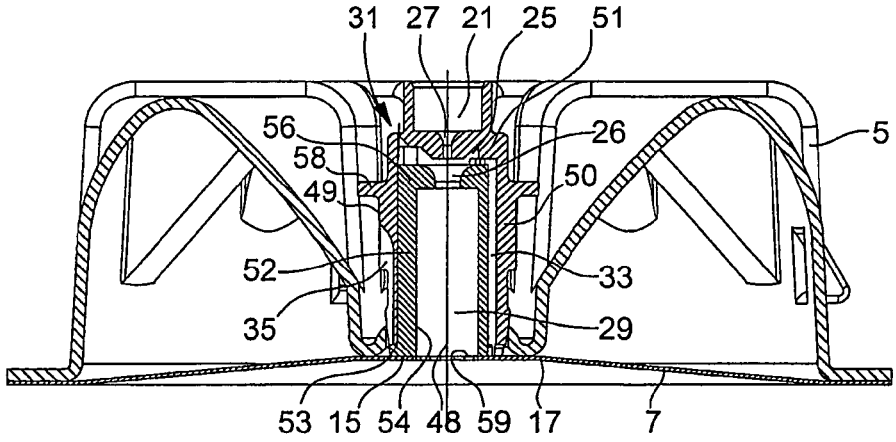
FIG. 15 is a diametral section on XV-XV of FIG. 14, prior to opening.
Figure 16:
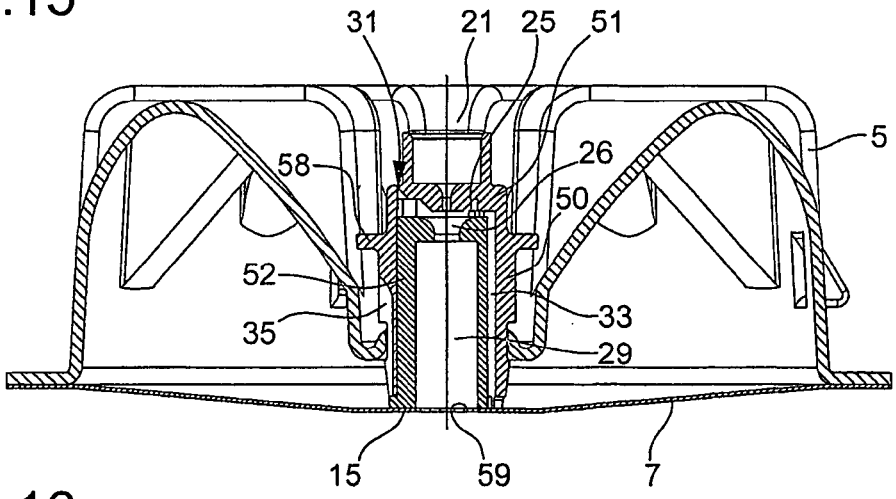
FIG. 16 corresponds to FIG. 15, after opening.

FIGS. 14 to 16 depict a second embodiment of a pumping device according to the invention, in which elements identical to those described in conjunction with the previous figures have the same numerical references.

According to this second embodiment, the nozzle 2 may be produced in two parts 50, 52 that can be fitted inside one another, for example by clipping (not depicted). It comprises a first, hollow, outer, body 50, the end wall 51 of which has, passing through it, the pressurized carrier fluid carrying duct 21 and the air carrying duct 31 when froth is to be produced. The outer wall 49 further comprises, as before, an air carrying canal 35 for equalizing the pressure in the packaging when the liquid is being pumped.

The second, inner, body 52 comprises, at its center, a recess delimited by a side wall 54 and an end wall 56 which form the mixing well 29. The end wall 56 has a constriction canal 26 passing through it. When the second body 52 is fitted inside the first body 50, the constriction canal 26 communicates with the aspiration chamber 25 which is formed between the end wall 5 of the outer body 50 and the end wall 56 of the inner body 52. The outer wall of the second body 52 comprises a groove connecting its base 53 and the aspiration chamber 25 to form, against the wall of the outer body 50, the canal 33 carrying the liquid that is to be pumped. As in the second embodiment, the base 53 of the inner body 52, and possibly that of the outer body 50, is firmly welded to a ring 15 of the seal, and the base of the hollow shaft 9 is welded, with a lesser tear-off force on a ring 17 surrounding the ring 15. In this second embodiment, it will be seen that the nozzle no longer has fins, just a guide flange 58.

This embodiment has the advantage of allowing for simpler manufacture of the nozzle which can easily be produced as two molded components of relatively simple shape.

This second embodiment also differs from the first one in that the ejection duct 48 is closed off by a grating 59 allowing the ejected preparation to be homogenized and its quality therefore improved. The grating may, depending on the embodiment, be formed of a separate component or as an integral part of the seal.

Figure 17:
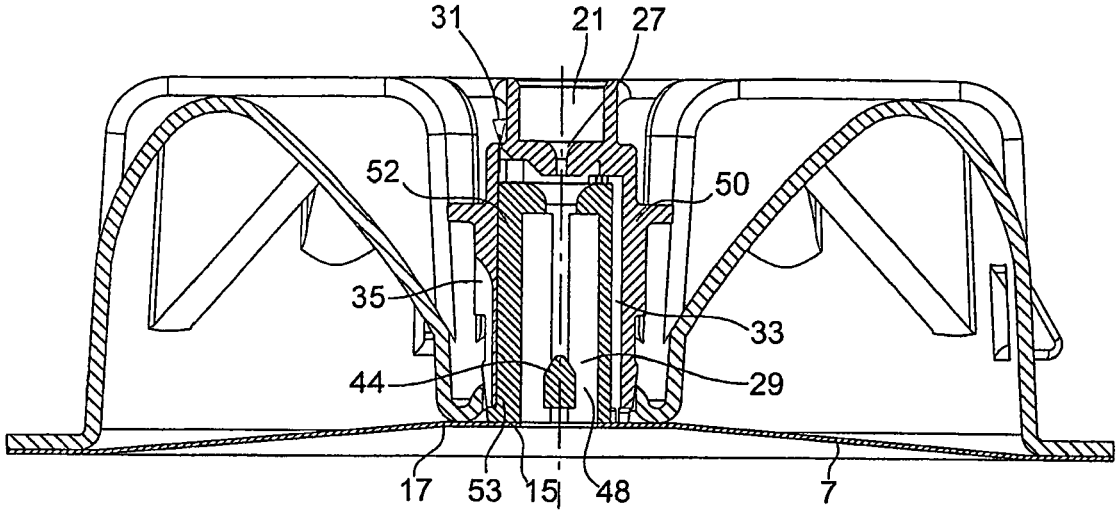
FIGS. 17 and 18 correspond to a variant of the second embodiment, before and after opening.
Figure 18:
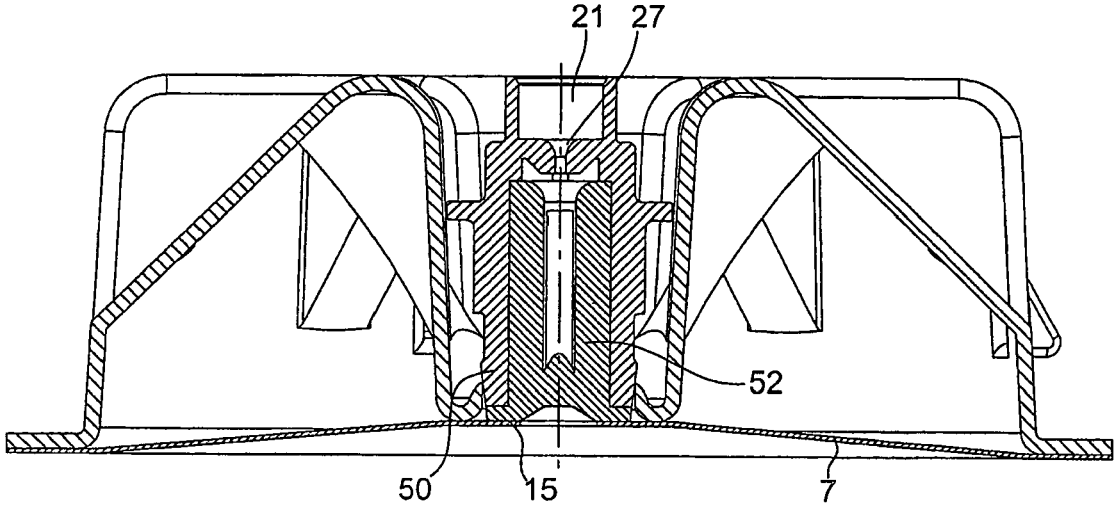

FIGS. 17 and 18 depict a variant of the previous embodiment which differs from the previous one in that the homogenizing means are formed of a dome 44 arranged in the mixing well 29 and formed as an integral part of the interior wall 54 of the inner body 52. This dome 44 is structured more or less in the same way as the joining element 13 described in FIGS. 6 to 8. In this case, the grating 59 may also be present.

FIG. 17 depicts the device in a closed position in a diametral cross section passing through the liquid carrying or pumping passage 33, and FIG. 18 depicts the same device in the open position, in a cross section taken at right angles to the first.

Figure 19:
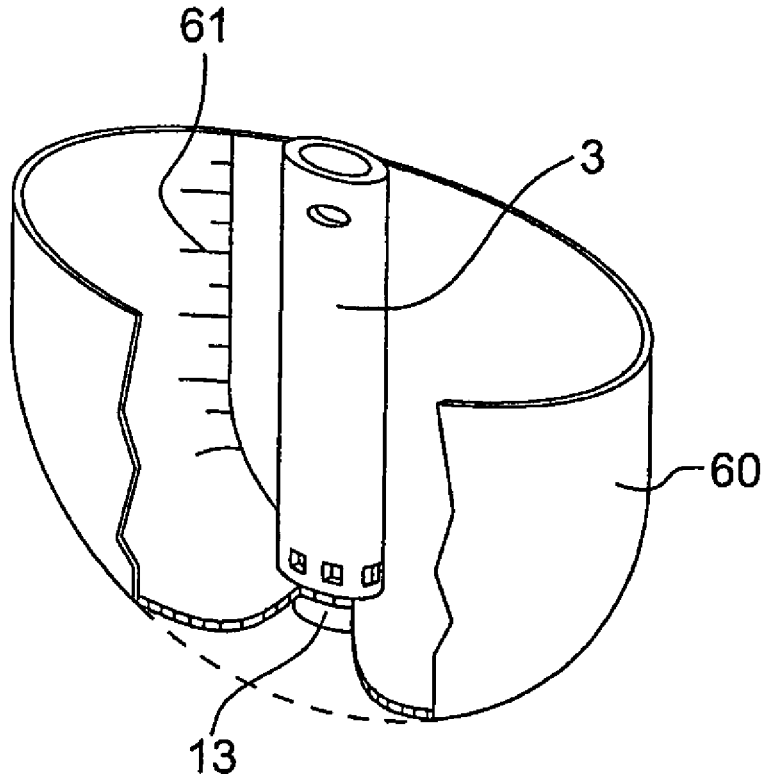
FIG. 19 is a perspective depiction with partial cut away of a third embodiment of a pumping device according to the invention.

FIG. 19 depicts, in perspective with cut away, a third embodiment of a pumping device according to the invention in which in which the nozzle 3 passes through the end wall of an open rigid container 60, in the form of a bowl, possibly comprising a graduated scale 61 so that the amount of liquid poured out can be measured or, conversely, so that the amount of liquid consumed can be determined. As before, the nozzle 3 may be fixed by a joining element 13. It may also more simply be countersunk and bonded into a hole made in the end wall of the bowl 60. This embodiment differs from the embodiments described previously in that the aspiration orifices of the nozzle 3 are constantly in communication with the liquid contained inside the container and in that the container is open which means that the pressure equalizing duct is omitted.

For economic reasons, the body of the nozzle, or the elements of which it is made, is preferably manufactured by injection molding a plastic.

The term "welded" in this description is intended to cover any means of direct or indirect connection between two components such as, for example, thermal conduction, induction, photon or ultrasound welding or alternatively adhesive bonding, or a combination of these means.

The term "liquid" in this description is intended in the broadest sense to mean any phase or combination of phases of incompressible or almost-incompressible fluids comprising solid inclusions or not and having the capability of being pumped through ducts.

Without departing from the scope of the present invention, the person skilled in the art may make various modifications, for example to adapt the exterior shape of the nozzle to suit the particular shape of a container containing the food liquid.

The device is particularly well suited to the pumping of a food liquid such as milk or a milk-based concentrate, from said packaging.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A device for pumping a liquid from a packaging so as to dispense it in heated, frothed or emulsified form, comprising an aspiration subassembly of a venturi type, connectable to a pipe of a pressurized-carrier fluid generator, said subassembly comprising a body comprising a carrier fluid carrying duct opening into an aspiration chamber, and at least one aspiration canal for aspirating the liquid contained in the packaging, wherein the aspiration subassembly comprises a nozzle and fixing and opening means designed to connect the nozzle with the packaging and place the aspiration canal in contact with the liquid inside the packaging, and wherein the nozzle is housed in a hollow shaft that extends from a top of the packaging to a bottom of the packaging.

2. The device as claimed in claim 1, wherein the fixing and opening means are capable of securing the nozzle to a seal of the packaging, and the nozzle is moveable relative to the packaging between a position in which the packaging is closed by the seal and a position in which the packaging is open and the aspiration canal is placed in communication with the liquid contained in said packaging.

3. The device as claimed in claim 2, wherein the fixing and opening means are so constructed and arranged as to place the aspiration canal in communication with the liquid contained in the packaging without the flow of the liquid to the outside.

4. The device as claimed in claim 3, wherein the fixing and opening means are capable of opening a portion of the weld between the seal and remaining portions of the packaging.

5. The device as claimed in claim 2, wherein the fixing and opening means comprise a joining element capable of connecting the nozzle to the seal.

6. The device as claimed in claim 5, wherein the nozzle is housed in the hollow shaft formed at right angles to the plane of the seal of the packaging, one end of the hollow shaft being connected to the seal by a second welded seal.

7. The device as claimed in claim 2, wherein the fixing and opening means form a welded seal between the seal and the base of the nozzle.

8. The device as claimed in claim 2, wherein the aspiration chamber is located downstream of a restriction and is connected by a constriction to a mixing well in communication with the outside via an ejection duct.

9. The device as claimed in claim 1, comprising an air carrying canal opening into the aspiration chamber.

10. The device as claimed in claim 9, wherein the air carrying canal carrying air to the aspiration chamber omprises an inlet orifice having a cross section larger than the remainder of said canal, said orifice being closed off by a permeable membrane allowing the air flow rate to be controlled.

11. The device as claimed in claim 1, wherein the liquid supply canal extends between the base of the nozzle and the aspiration chamber.

12. The device as claimed in claim 1, comprising a packaging and in that said device is disposable with the packaging.

13. A device for pumping a liquid from a container so as to dispense it in heated, frothed or emulsified form, comprising an aspiration subassembly comprising a nozzle of a venturi type connectable to a pipe of a pressurized-carrier fluid generator, said subassembly comprising a body comprising a carrier fluid carrying duct opening into an aspiration chamber, and at least one aspiration canal for aspirating a liquid contained in the container and opening into said container a liquid supply canal being formed in an actual body of the nozzle between its base and the aspiration chamber, and in that the ejection duct passes through a bottom end wall of the container, forming a seal against the liquid contained in said container, and wherein the nozzle is housed in a hollow shaft that extends from a top of the container to the bottom end wall of the container.

14. The device as claimed in claim 13, wherein the aspiration chamber is connected by a constriction to a mixing well in communication with the outside via an ejection duct situated at a base of the body of said nozzle.

15. The device as claimed in claim 13, wherein the nozzle is made of a body made in two parts consisting in a first, outer, body, through which the carrier fluid carrying duct and the air carrying duct pass, and into which there is fitted to a second, inner, body through which there passes a constriction communicating with the aspiration chamber formed between said first and second bodies, the liquid carrying canal being formed between the walls of said first and second bodies.

16. The device as claimed in claim 15, comprising a dome formed at the base of the inner body.

17. A device for pumping a liquid from a packaging so as to dispense it in heated, frothed or emulsified form, comprising an aspiration subassembly of a venturi type, connectable to a pipe of a pressurized-carrier fluid generator, said subassembly comprising a body comprising a carrier fluid carrying duct opening into an aspiration chamber, and at least one aspiration canal for aspirating the liquid contained in the packaging, wherein the aspiration subassembly comprises a nozzle and fixing and opening means designed to connect the nozzle with the packaging and place the aspiration canal in contact with the liquid inside the packaging, wherein the fixing and opening means are capable of securing the nozzle to a seal of the packaging, and the nozzle is moveable relative to the packaging between a position in which the packaging is closed by the seal and a position in which the packaging is open and the aspiration canal is placed in communication with the liquid contained in said packaging, the fixing and opening means forming a welded seal between the seal between the seal and the base of the nozzle, wherein the welded seal delimits an opening in the seal, and the ejection duct is in communication with said opening.

18. The device as claimed in claim 17, comprising a grating forming means of homogenizing the ejected product that extends across said opening.

19. A device for pumping a liquid from a packaging so as to dispense it in heated, frothed or emulsified form, comprising an aspiration subassembly of a venturi type, connectable to a pipe of a pressurized-carrier fluid generator, said subassembly comprising a body comprising a carrier fluid carrying duct opening into an aspiration chamber, and at least one aspiration canal for aspirating the liquid contained in the packaging, wherein the aspiration subassembly comprises a nozzle and fixing and opening means designed to connect the nozzle with the packaging and place the aspiration canal in contact with the liquid inside the packaging, wherein the fixing and opening means are capable of securing the nozzle to a seal of the packaging, and the nozzle is moveable relative to the packaging between a position in which the packaging is closed by the seal and a position in which the packaging is open and the aspiration canal is placed in communication with the liquid contained in said packaging, wherein the fixing and opening means comprise a joining element capable of connecting the nozzle to the seal, wherein the nozzle is housed in a hollow shaft formed at right angles to the plane of the seal of the packaging, one end of the hollow shaft beign connected to the seal by a second welded seal, wherein the nozzle further comprises, between its body and the hollow shaft, a canal allowing air to be introduced into the packaging via an orifice so as to equalize the pressure in the open position.

20. The device of claim 19, wherein the orifice of the pressure equalizing canal is situated below the hollow shaft when the packaging is in an open position.

21. A device for pumping a liquid from a packaging so as to dispense it in heated, frothed or emulsified form, comprising an aspiration subassembly of a venturi type, connectable to a pipe of a pressurized-carrier fluid generator, said subassembly comprising a body comprising a carrier fluid carrying duct opening into an aspiration chamber, and at least one aspiration canal for aspirating the liquid contained in the packaging, wherein the aspiration subassembly comprises a nozzle and fixing and opening means designed to connect the nozzle with the packaging and place the aspiration canal in contact with the liquid inside the packaging, wherein the fixing and opening means are capable of securing the nozzle to a seal of the packaging, and the nozzle is moveable relative to the packaging between a position in which the packaging is closed by the seal and a position in which the packaging is open and the aspiration canal is placed in communication with the liquid contained in said packaging, wherein the fixing and opening means comprise a joining element capable of connecting the nozzle to the seal, wherein the nozzle is housed in a hollow shaft formed at right angles to the plane of the seal of the packaging, one end of the hollow shaft beign connected to the seal by a second welded seal, and wherein the nozzle is provided at its upper part with a plurality of fins collaborating with ribs radiating from the opening of the hollow shaft to prevent the nozzle from rotating relative to the packaging.

* * * * *